US010764965B2

(12) United States Patent
Lee et al.

(10) Patent No.: US 10,764,965 B2
(45) Date of Patent: Sep. 1, 2020

(54) SURFACE HEATER, ELECTRIC RANGE HAVING THE SAME, AND MANUFACTURING METHOD THEREOF

(71) Applicant: LG ELECTRONICS INC., Seoul (KR)

(72) Inventors: Youngjun Lee, Seoul (KR); Kyoungjin Ku, Seoul (KR); Deokhyun Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 684 days.

(21) Appl. No.: 15/440,598

(22) Filed: Feb. 23, 2017

(65) Prior Publication Data

US 2017/0245323 A1 Aug. 24, 2017

(30) Foreign Application Priority Data

Feb. 24, 2016 (KR) ..... 10-2016-0021725

(51) Int. Cl.
*H05B 3/12* (2006.01)
*H05B 3/68* (2006.01)
(Continued)

(52) U.S. Cl.
CPC ..... *H05B 3/12* (2013.01); *B22F 7/064* (2013.01); *H05B 3/26* (2013.01); *H05B 3/688* (2013.01);
(Continued)

(58) Field of Classification Search
CPC ..... B22F 2301/255; B22F 2302/25; B22F 7/064; H05B 2203/003; H05B 2203/017; H05B 3/12; H05B 3/26; H05B 3/688; H05B 3/74
USPC ..... 219/553, 494, 541, 542, 543, 219/443.1–468.2, 538–548, 444.1, 465.1, 219/466.1, 467.1, 544, 546; 118/724, 118/725, 728; 501/80, 81, 82, 83, 84, 85, 501/134; 429/495, 496, 510, 514, 457; 361/301.1, 321.1
See application file for complete search history.

(56) References Cited

U.S. PATENT DOCUMENTS 3,459,921 A * 8/1969 Fussell ..... F24C 14/02 219/396
3,565,684 A * 2/1971 Buck ..... C04B 35/08 428/432
(Continued)

FOREIGN PATENT DOCUMENTS

DE 3116589 A1 3/1982
KR 20-0399652 Y1 10/2005
(Continued)

*Primary Examiner* — Dana Ross
*Assistant Examiner* — Ket D Dang
(74) *Attorney, Agent, or Firm* — Dentons US LLP

(57) ABSTRACT

An apparatus including a surface heater, the surface heater including a substrate having a surface formed of an electrically insulating material, heating element attached to the surface of the substrate by sintering predetermined powder including lanthanide oxide powder, and a power supply unit configured to supply electricity to the heating element wherein a manufacturing method of the surface heater includes baking the predetermined powder at a baking temperature of 900° C. or lower.

7 Claims, 5 Drawing Sheets

(51) Int. Cl.
*H05B 3/74* (2006.01)
*B22F 7/06* (2006.01)
*H05B 3/26* (2006.01)

(52) U.S. Cl.
CPC ..... *H05B 3/74* (2013.01); *B22F 2301/255* (2013.01); *B22F 2302/25* (2013.01); *H05B 2203/003* (2013.01); *H05B 2203/017* (2013.01)

(56) References Cited

U.S. PATENT DOCUMENTS 3,730,911 A * 5/1973 Aubin et al. ..... C04B 35/42 252/516
4,973,826 A * 11/1990 Baudry ..... H05B 3/748 219/466.1
5,800,787 A * 9/1998 Kato ..... B01J 35/0033 219/205
6,423,400 B1 * 7/2002 Yushio ..... B32B 37/12 428/210
6,921,882 B2 * 7/2005 Gadow ..... H05B 3/74 219/465.1
8,841,588 B2 * 9/2014 Liu ..... H05B 3/145 219/520
2002/0158060 A1 * 10/2002 Uchiyama ..... H01L 21/67109 219/444.1
2003/0015517 A1 * 1/2003 Fure ..... H01L 21/67103 219/444.1
2006/0102613 A1 * 5/2006 Kuibira ..... H01L 21/67109 219/444.1
2007/0009784 A1 * 1/2007 Pal ..... H01M 4/8621 429/432
2008/0107948 A1 * 5/2008 Yamanis ..... H01M 8/021 429/457
2009/0272728 A1 * 11/2009 Abbott ..... F24C 7/04 219/399
2009/0325782 A1 * 12/2009 Venkataramani ..... A47J 36/02 502/2
2010/0098996 A1 * 4/2010 Hwang ..... H01M 4/8621 429/454
2010/0170884 A1 * 7/2010 Iwata ..... H01L 21/67109 219/444.1
2012/0178016 A1 7/2012 Park et al.
2013/0295484 A1 11/2013 Seo et al.
2014/0023957 A1 * 1/2014 Brandner ..... B32B 18/00 429/509
2014/0169845 A1 * 6/2014 Nakahara ..... G03G 15/2053 399/328
2014/0170529 A1 * 6/2014 Jain ..... H01M 4/8657 429/486

FOREIGN PATENT DOCUMENTS

KR 10-2009-0022057 A 3/2009
KR 10-2012-0057016 A 6/2012
WO 2013/177838 A1 12/2013

* cited by examiner

【Figure 1】
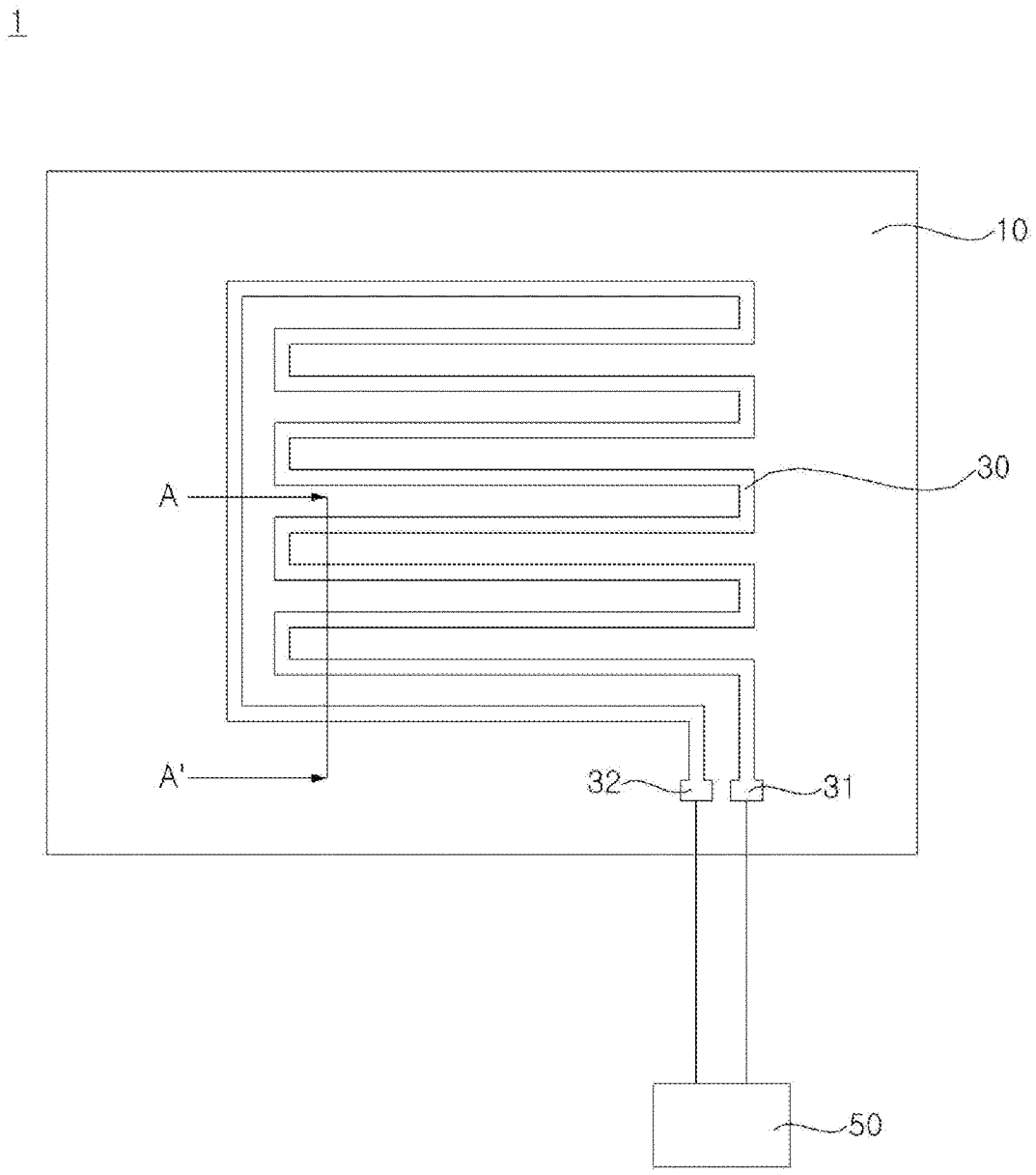

【Figure 2】
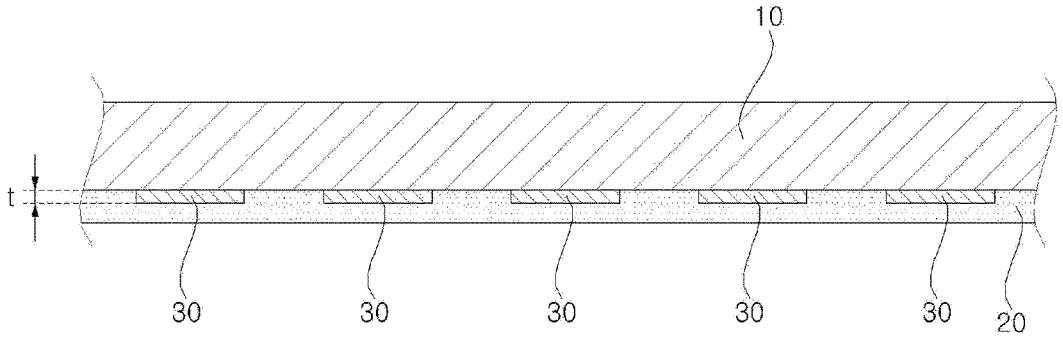
【Figure 3】
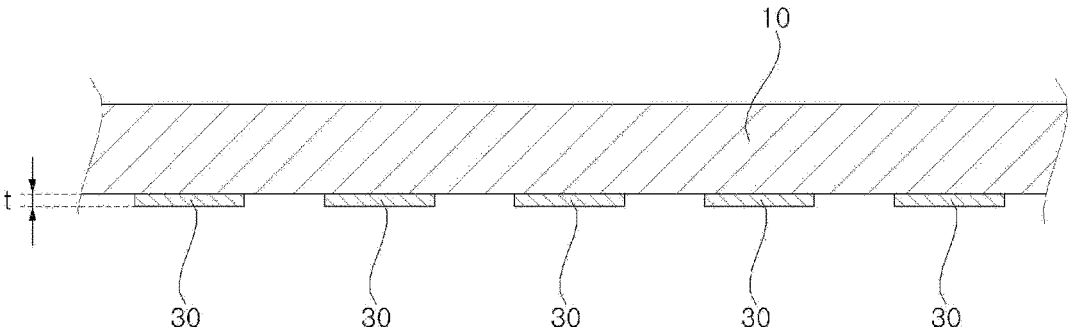

【Figure 4】
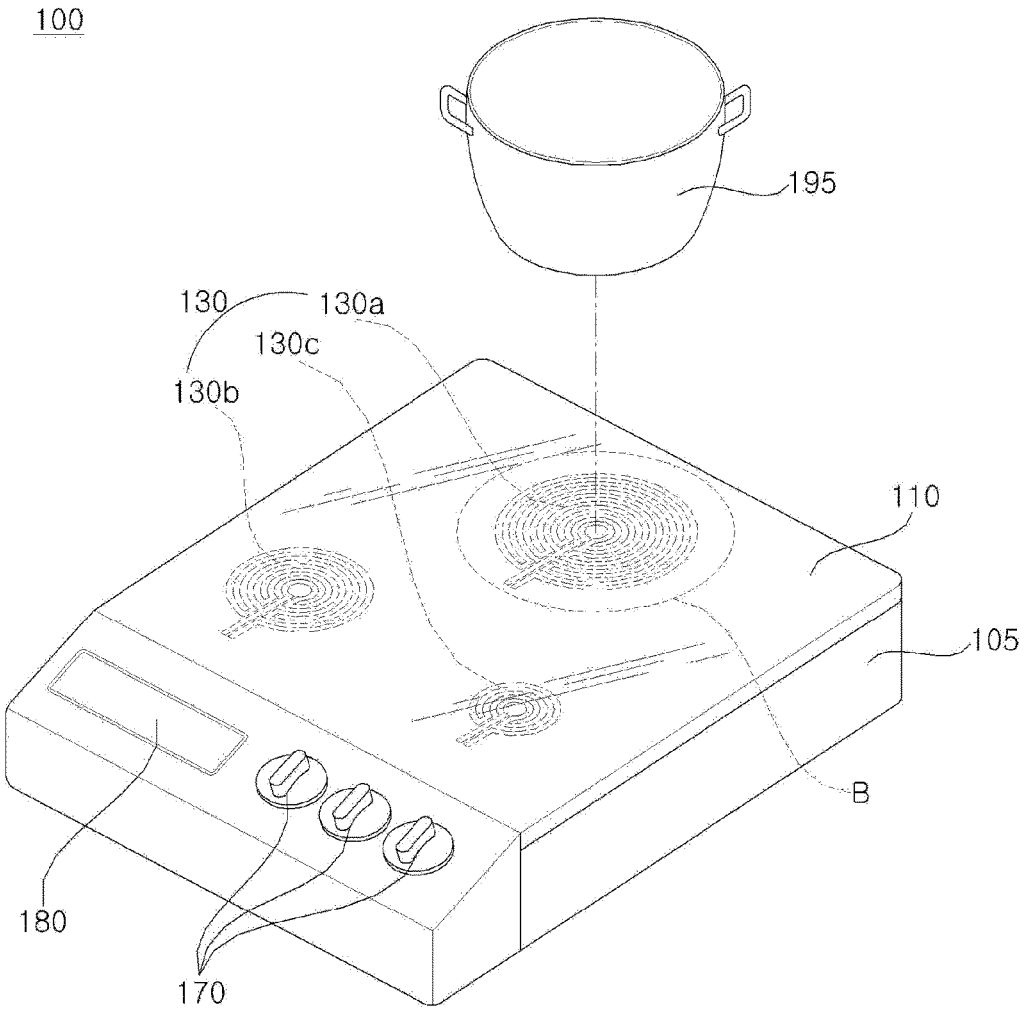

【Figure 5】
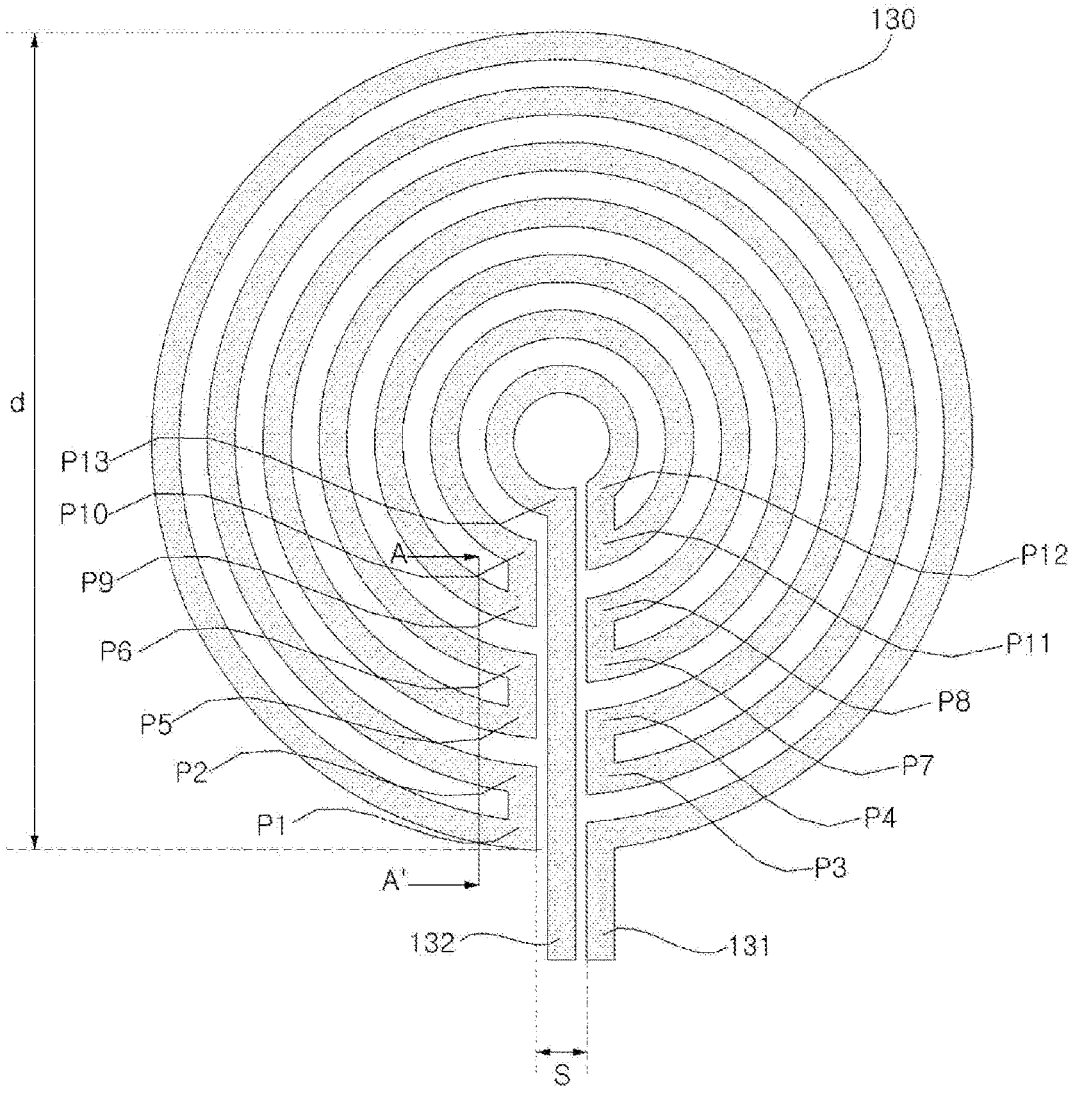

【Figure 6】
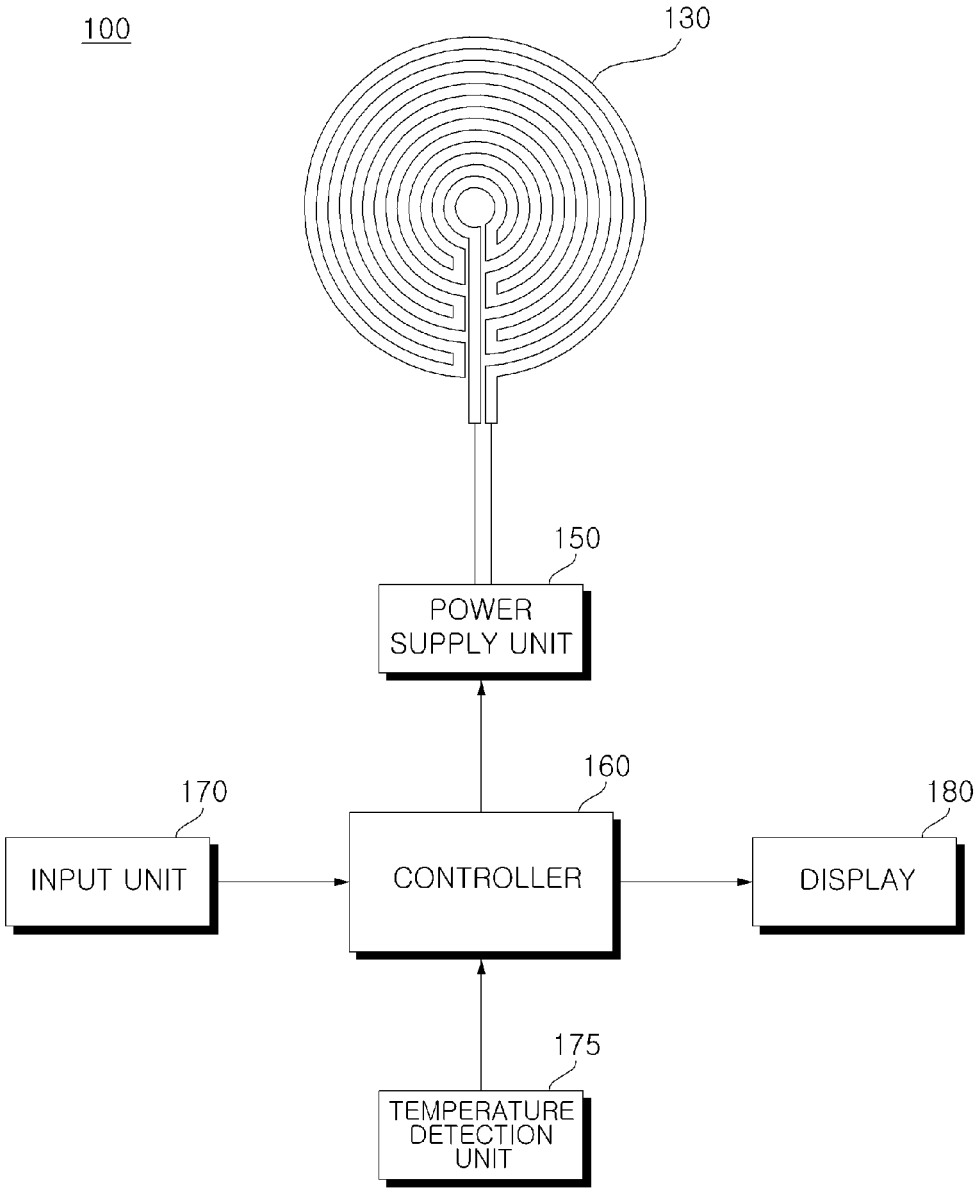

SURFACE HEATER, ELECTRIC RANGE HAVING THE SAME, AND MANUFACTURING METHOD THEREOF

CROSS-REFERENCE TO RELATED APPLICATION

This application claims the priority benefit of Korean Patent Application No. 10-2016-0021725, filed on Feb. 24, 2016 in the Korean Intellectual Property Office, the disclosure of which is incorporated herein by reference.

BACKGROUND OF THE INVENTION

1. Field of the invention

The present invention relates to a surface heater using a heating element, which generates heat by electricity, an electric range having the same, and a manufacturing method thereof.

2. Description of the Related Art

In general, a cooktop is a cooking apparatus which heats a container mounted on the upper surface thereof to heat food contained in the container. Cooktops are divided into gas ranges which directly generate flame using gas, and electric ranges which heat a container and/or food mounted on a substrate using electricity.

Conventionally, a heating element is formed by applying a paste containing a metal material, such as Ag—Pd, and glass frit to the rear surface of a substrate formed of glass or stainless steel and then sintering the same. A plate-shaped heater which generates heat by supplying electricity to such a heating element has been known.

SUMMARY OF THE INVENTION

An object of the present invention is to provide a surface heater which may solve delamination of a heating element, formed of a metal as a main ingredient and having a large coefficient of expansion, from a substrate due to a difference in expansion degrees between the heating element and the substrate according to temperature change.

Another object of the present invention is to provide a surface heater which may solve restriction on the upper limit temperature, for example, the maximum temperature, of a heating element formed of Ag—Pd as a main ingredient to about 500° C. to prevent delamination of the heating element.

Another object of the present invention is to provide a surface heater which may solve high manufacturing costs of a heating element due to high price of Pd as one ingredient of the heating element.

Another object of the present invention is to provide a surface heater which may implement desired specific resistance of a heating element while achieving the above-described objects.

Yet another object of the present invention is to provide a surface heater which may lower the baking temperature of a heating element applied to a substrate on the grounds that a glass substrate may be deformed at a temperature of about 950° C. or higher and thus prevented from being heated to a temperature of about 850° C. or higher.

The objects of the present invention are not limited to the above-mentioned objects and other objects that have not been mentioned above will become evident to those skilled in the art from the following description.

To achieve the above objects, there is provided a surface heater according to an exemplary embodiment of the present invention, including a substrate including a surface formed of an electrically insulating material, a heating element attached to the surface of the substrate, the heating element including lanthanide oxide, and a power supply unit configured to supply electricity to the heating element to generate heat.

The lanthanide oxide may be one selected from the group consisting of LSM, LSCF, LNF and LC.

The heating element may be attached to the surface of the substrate by sintering a predetermined powder including lanthanide oxide powder.

The heating element may further include metal.

The predetermined powder may further include metal powder.

The metal may be one selected from the group consisting of Ag, Ag—Pd and Cu.

The heating element may include 30 to 60% by weight of the lanthanide oxide and 40 to 70% by weight of the metal.

The predetermined powder may include 30 to 60% by weight of the lanthanide oxide powder and 40 to 70% by weight of the metal powder.

To achieve the above objects, there is provided an electric range according to an exemplary embodiment of the present invention, including the surface heater.

The surface of the substrate may be formed of glass, and the lanthanide oxide may be LC.

The particle size of the lanthanide oxide powder may be 0.4 μm.

The metal may be Ag.

The heating element includes 40 to 55% by weight of the lanthanide oxide and 45 to 60% by weight of the metal.

The predetermined powder may include 40 to 55% by weight of the lanthanide oxide powder and 45 to 60% by weight of the metal powder.

The surface of the substrate may be formed of glass and, in this case, in order to improve adhesive force between the heating element and the substrate, the predetermined powder may further include glass powder.

To achieve the above objects, there is provided a manufacturing method of the surface heater according to an exemplary embodiment of the present invention, including baking the predetermined powder at a baking temperature of 900° C. or lower.

The manufacturing method may further include manufacturing a paste by mixing an organic solvent and a binder with the predetermined powder, applying the paste to the surface of the substrate in a predetermined shape, and drying the applied paste at a predetermined temperature and removing the organic solvent and the binder from the paste, and baking of the predetermined powder may be carried out after drying of the applied paste.

BRIEF DESCRIPTION OF THE DRAWINGS

The above and other objects, features and other advantages of the present invention will be more clearly understood from the following detailed description taken in conjunction with the accompanying drawings, in which:

FIG. 1 is an elevation view of a surface heater in accordance with one embodiment of the present invention, as seen from above a substrate;

FIG. 2 is an exemplary enlarged cross-sectional view of the surface heater of FIG. 1, taken along line A-A';

FIG. 3 is another exemplary enlarged cross-sectional view of the surface heater of FIG. 1, taken along line A-A';

FIG. 4 is a perspective view of an electric range in accordance with one embodiment of the present invention;

FIG. 5 is an enlarged elevation view illustrating a predetermined shape (pattern) of a heating element of a portion B of FIG. 4; and FIG. 6 is an exemplary block diagram of the inner configuration of the electric range of FIG. 4.

DETAILED DESCRIPTION OF THE EMBODIMENTS

The advantages and features of the present invention, and the way of attaining the same, will become apparent with reference to embodiments described below in conjunction with the accompanying drawings. Reference will now be made in detail to the preferred embodiments of the present invention, examples of which are illustrated in the accompanying drawings. Wherever possible, the same reference numbers will be used throughout the drawings to refer to the same or like parts.

With reference to FIGS. 1 to 3, a surface heater 1 in accordance with one embodiment of the present invention includes a substrate 10 having surfaces formed of an electrically insulating material, a heating element 30 attached to the surface of the substrate 10 by sintering a predetermined powder including lanthanide oxide powder, and a power supply unit 50 to supply electricity to the heating element 30.

The substrate 10 may be a plate-shaped member. The substrate 10 may be manufactured to have various sizes and shapes according to the needs of an apparatus using the surface heater 1. The substrate 10 may have different thicknesses as needed. The substrate 10 may be bent.

The heating element 30 may be attached to one of both surfaces of the substrate 10. Heat generated by the heating element 30 is conducted to the substrate 10. Heat generated by the heating element 30 attached to one surface of the substrate 10 is conducted to the other surface of the substrate 10.

At least a portion of the surface of the substrate 10, to which the heating element 30 is attached, is formed of an electrically insulating material. This may be implemented through various methods. For example, the substrate 10 may be an integral member formed of one electrically insulating material. The substrate 10 may be a member in which an electrically insulating material is applied to the surfaces of an inner structure formed of another material. The substrate 10 may be a member in which one electrically insulating material is applied to only one of both surfaces of a structure formed of another material.

The surface heater 1 may include, as exemplarily shown in FIG. 2, a coating layer 20 disposed to cover the heating element 30 applied to some regions of the surface of the substrate 10. The coating layer 20 is formed of an electrically insulating material. The coating layer 20 may be formed of the same material as that of the surface of the substrate 10 or be formed of a different material from that of the surface of the substrate 10.

Further, the power supply unit 50 supplies electricity to the heating element 30. The power supply unit 50 may include a voltage source (not shown). The power supply unit 50 may include a switch (not shown) to supply or interrupt electricity. The power supply unit 50 may include a transformer (not shown) to adjust the intensity of applied voltage.

The heating element 30 includes a first terminal 31 located at a start part of the heating element 30 and a second terminal 32 located at an end part of the heating element 30 in the flow direction of supplied electricity. The first terminal 31 and the second terminal 32 may be connected to the power supply unit 50 by wires so as to apply current from the power supply unit 50 to the heating element 30.

The heating element 30 is disposed in a designated planar shape on the substrate 10. With reference to FIG. 1, for example, the heating element 30 may be extended in the leftward and rightward directions and formed in zigzag on the surface of the substrate 10. The heating element 30 may be formed in the predetermined shape in which the first terminal 31 and the second terminal 32 are connected in series.

The heating element 30 is formed by sintering a predetermined powder including lanthanide oxide powder. Hereinafter, a temperature at which the predetermined powder is sintered is referred to as a "baking temperature". Lanthanum is an element having the elementary symbol of La. A lanthanide oxide means an oxidized compound including at least lanthanum (La). The lanthanide oxide has electrical conductivity and may thus be used as a heating element using electricity.

The lanthanide oxide may be any one selected from the group consisting of Lanthanum Strontium Manganite (LSM), Lanthanum Strontium Cobalt Ferrite (LSCF), Lanthanum Nickel Ferrite (LNF) and Lanthanum Cobalt (LC) oxides.

The lanthanide oxide has excellent oxidation resistance and the heating element 30 may not be deformed, even if the surface of the heating element 30 is exposed to outdoor atmosphere without a coating layer 20, as exemplarily shown in FIG. 3.

Further, the lanthanide oxide has a coefficient of expansion of about $10.8*10^{-6}$ to $12.3*10^{-6}$/K, which is lower than the coefficients of expansion of metals, and thus prevents delamination of the heating element 30 from the substrate 10 generated due to a difference in volume expansion degrees between the heating element 30 and the substrate 10 according to temperature change.

The predetermined powder may include powder of other materials in addition to powder of the lanthanide oxide. The predetermined powder may include metal powder. The predetermined powder may be a mixture of the lanthanide oxide powder and the metal powder.

Metals have higher electrical conductivity than lanthanide oxides. As the predetermined powder includes a large amount of the metal powder, specific resistance of the heating element 30 is lowered.

In one experimental example, in case of a heating element acquired by sintering a predetermined powder including lanthanide oxide powder alone, even if the lanthanide oxide powder is sintered at the same baking temperature, there is high variability in specific resistance. In this experimental example, every time a plurality of the same samples is sintered at the same baking temperature, measured specific resistance values of the heating element 30 are varied within the range of about $10^{-4}$ to 1 Ωcm, and specific resistance values at local areas of the heating element 30 are not uniform.

By adding the metal powder to the predetermined powder, effects of the lanthanide oxide may be exhibited and specific resistance of the heating element 30 within a desired range may be highly repeatable, thereby allowing a designer to easily design the heating element 30 having specific resistance in a desired range.

The metal powder may be acquired from any known metal. The metal may be any one selected from the group consisting of Ag, Ag—Pd and Cu.

The baking temperature of the lanthanide oxide is similar to the baking temperatures of Ag, Ag—Pd and Cu, rather than the baking temperatures of other metals. If the metal is selected from the group consisting of Ag, Ag—Pd and Cu, all particles of the predetermined powder may be effectively sintered during a baking process to sinter the predetermined powder.

Further, since the baking temperatures of Ag, Ag—Pd and Cu are lower than the baking temperature of the lanthanide oxide, the baking temperature of a predetermined powder further including any one of Ag, Ag—Pd and Cu becomes lower than the baking temperature of a predetermined powder including the lanthanide oxide alone. This is very advantageous in a case that the surface of the substrate 10 is formed of glass.

In experimental example 1, results of specific resistances (Ωm) of heating element 30 according to kinds of lanthanide oxides of the predetermined powder are described. The independent variable of experimental example 1 is the kind of the lanthanide oxide, i.e., LC, LCM, LSCF or LNF. The dependent variable of experimental example 1 is the specific resistance of the heating element 30. Experimental example 1 is carried out at a baking temperature of 850° C. and a baking temperature of 900° C. The results of experimental example 1 are experimental results if the predetermined powder includes lanthanide oxide powder and Ag in a weight ratio of 50:50. Table 1 below briefly states the results of experimental example 1. Hereinafter, E-x means $10^{-x}$.

TABLE 1

| | Kind of lanthanide oxide | | | |
|---|---|---|---|---|
| Temp. (° C.) | LC | LSM | LSCF | LNF |
| 850° C. | 2.89E−04 Ωm | — | — | — |
| 900° C. | 1.69E−04 Ωm | 1.50E−03 Ωm | 3.51E−03 Ωm | 8.59E−04 Ωm |

In experimental example 1, if the predetermined powder is heated at a baking temperature of 850° C., the measured specific resistance of the heating element 30 formed by sintering the predetermined powder including LC is 2.89E−04 Ωm, but the predetermined powder including any one of LSM, LSCF and LNF cannot be effectively sintered and thus specific resistance thereof cannot be measured.

In experimental example 1, if the predetermined powder is heated at a baking temperature of 900° C., the measured specific resistance of the heating element 30 formed by sintering the predetermined powder including LC is 1.69E−04 Ωm, the measured specific resistance of the heating element 30 formed by sintering the predetermined powder including LSM is 1.50E−03 Ωm, the measured specific resistance of the heating element 30 formed by sintering the predetermined powder including LSCF is 3.51E−03 Ωm, and the measured specific resistance of the heating element 30 formed by sintering the predetermined powder including LNF is 8.59E−04 Ωm.

Hereinafter, in experimental example 2, a more detailed experiment on LC used as a lanthanide oxide is carried out. Experimental results of experimental example 2 may be applied to other lanthanide oxides in addition to LC.

In experimental example 2, results of specific resistances (cm) of heating element 30 according to weight ratios of lanthanide oxide powder to metal powder of the predetermined powder are described. The independent variable of experimental example 2 is the weight ratio of the lanthanide oxide powder to the metal powder, and the dependent variable of experimental example 2 is specific resistance of the heating element 30. Experimental example 2 is carried out at a baking temperature of 850° C. and a baking temperature of 900° C. In experimental example 2, LC powder is used as the lanthanide oxide powder and Ag powder is used as the metal powder. Table 2 below briefly states the results of experimental example 2.

TABLE 2

| | Weight ratio of LC:Ag | | | | | | | |
|---|---|---|---|---|---|---|---|---|
| Temp. (° C.) | 90:10 | 70:30 | 60:40 | 55:45 | 50:50 | 45:55 | 40:60 | 30:70 |
| 850° C. | 8.60E−01 Ωm | 9.38E−01 Ωm | 1.24E−01 Ωm | 2.47E−02 Ωm | 4.86E−04 Ωm | 3.06E−04 Ωm | 6.52E−05 Ωm | 1.52E−05 Ωm |
| 900° C. | 3.50E−01 Ωm | 2.70E−01 Ωm | 4.62E−02 Ωm | 5.62E−03 Ωm | 1.69E−04 Ωm | 1.57E−04 Ωm | 5.31E−05 Ωm | 1.41E−05 Ωm |

The experimental results of Table 2 are described below. If the predetermined powder including 70% by weight of LC powder and 30% by weight of Ag powder is heated at a baking temperature of 850° C., the measured specific resistance of the heating element 30 is 9.38E−01 Ωm. If the predetermined powder including 45% by weight of LC powder and 55% by weight of Ag powder is heated at a baking temperature of 900° C., the measured specific resistance of the heating element 30 is 1.57E−04 Ωm.

The weight ratio of the lanthanide oxide powder to the metal powder of the predetermined powder may be variously implemented. For example, the predetermined powder may include 25% by weight of the lanthanide oxide powder and 75% by weight of the metal powder. The predetermined powder may include 75% by weight of the lanthanide oxide powder and 25% by weight of the metal powder. The predetermined powder may include 73% by weight of the lanthanide oxide powder, 25% by weight of the metal powder, and 2% by weight of an arbitrary ingredient powder, which will be described later. That is, the predetermined powder may include 25 to 75% by weight of the lanthanide oxide powder and 25 to 75% by weight of the metal powder.

Preferably, the predetermined powder includes 30 to 60% by weight of the lanthanide oxide powder and 40 to 70% by weight of the metal powder. For example, the predetermined powder may include 35% by weight of the lanthanide oxide powder and 65% by weight of the metal powder. The predetermined powder may include 60% by weight of the lanthanide oxide powder and 40% by weight of the metal powder. The predetermined powder may include 58% by weight of the lanthanide oxide powder, 40% by weight of the metal powder, and 2% by weight of an arbitrary ingredient powder, which will be described later.

Since the specific resistances of metals are excessively low, if the weight percentage of the metal powder is increased to a designated reference or more, the heating function of the heating element 30 is restricted. In the surface heater 1, the specific resistance of the heating element 39 may be $10^{-5}$ cm or more so as to exhibit the heating function. In order to acquire such specific resistance, the weight percentage of the metal powder may be restricted to a specific value or less and, with reference to Table 2, the weight percentage of the metal powder is preferably 70% by weight or less.

Further, if the weight percentage of the metal powder is increased to a designated reference or more, the specific resistance of the heating element 30 is remarkably increased as the temperature of the heating element 30 is increased. Therefore, the weight percentage of the metal powder may be properly restricted.

Further, if the weight percentage of the lanthanide oxide powder is increased to a designated reference or more, whenever the heating element 30 is manufactured, it is difficult to acquire uniform specific resistance of the heating element 30. A description thereof has been given above. In experimental example 2, results, in which it is difficult to measure uniform specific resistance of the heating element 30 if the predetermined powder including 70% by weight or 90% by weight is sintered, are deduced. Therefore, the weight percentage of the lanthanide oxide powder may be 60% by weight or less.

Further, a heating element 30 having specific resistance of $10^{-1}$ Ωm or less may be implemented. In order to execute surface heating of the surface heater 1, the heating element 30 needs to have a designated length or more and, as the length of the heating element 30 increases, a resistance value increases. Therefore, by restricting the specific resistance of the heating element 30 to a proper value or less, the surface heater 1 may be effectively designed.

The above-described arbitrary ingredient may include the same material as the material of the surface of the substrate 10. Thereby, adhesive force between the substrate 10 and the heating element 30 may be improved.

For example, if the substrate 10 is formed of glass, the arbitrary ingredient may include glass. The predetermined powder may be a mixture including the lanthanide oxide powder, the metal powder and glass powder. The weight percentage of the glass powder in the predetermined powder is 2% or less. The weight percentage of the glass powder in the predetermined powder may be about 1%.

The material of the glass powder may be any one selected from the group consisting of $SiO_2$, $Bi_2O_3$, CuO, ZnO, $B_2O_3$ and $Al_2O_3$. The material of the glass powder may be a ZnO—$SiO_2$-based, $B_2O_3$—ZnO-based or $SiO_2$—$Al_2O_3$-based material.

The surface heater 1 may be used to generate hot air in a heater or an air conditioner of a vehicle. The surface heater 1 may be used to generate hot water in a laundry treating apparatus. The surface heater 1 may be used to heat paper in a printing apparatus, such as a photocopier. The surface heater 1 may be used to heat food and containers in an electric range. In addition, the surface heater 1 may be used in various technical fields.

Hereinafter, with reference to FIGS. 4 and 5, a surface heater 1 of an electric range 100 in accordance with one embodiment of the present invention will be described.

The electric range 100 may include a cabinet 105 provided with an opened upper surface. The cabinet 105 forms the external appearance of the electric range 100. Parts of the electric range 100 are disposed at the inside of the cabinet 105.

The electric range 100 includes the surface heater 1. A conventional heating element formed of Ag—Pd as a main ingredient is disadvantageous in that manufacturing costs are increased due to scarcity of Pd, but the heating element 130 of the surface heater 1 is formed of a lanthanide oxide as a main ingredient and thus solves such a problem.

The electric range 100 includes a substrate 110 having surfaces formed of an electrically insulating material. The substrate 110 may be disposed at the opened upper surface of the cabinet 105. Here, one surface of the substrate 110 in the upward direction is defined as an upper surface and the other surface of the substrate 110 in the downward direction is defined as a rear surface. The rear surface of the substrate 110 may be formed of glass or ceramics (for example, alumina). A description of parts of the substrate 110, which are substantially the same as those of the substrate 10, will be omitted.

The electric range 100 includes heating element 130 attached to the rear surface of the substrate 110 by sintering a predetermined powder. The heating element 130 includes a first terminal 131 located at a start part of the heating element 130 and a second terminal 132 located at an end part of the heating element 130 in the flow direction of supplied electricity. A description of parts of the heating element 130, which are substantially the same as those of the heating element 30, will be omitted.

A plurality of heating elements 130 may be disposed. In this embodiment, the heating element 130 includes a first heating element 130*a*, a second heating element 130*b* and a third heating element 130*c* in descending order of the areas thereof. The first heating element 130*a*, the second heating element 130*b* and the third heating element 130*c* may be disposed on the substrate 110 so as to have different sizes or shapes.

With reference to FIG. 5, the heating element 130 having a predetermined shape disposed on the substrate 110 in accordance with one embodiment will be described. The heating element 130 extends from the first terminal 131 to a first point P1 spaced apart from the first terminal 131 by a designated interval s in a circumferential shape in the counterclockwise direction. Thereafter, the heating element 130 extends from the first point P1 to a second point P2 spaced apart from the first point P1 by a designated distance in the centripetal direction, and extends from the second point P2 to a third point P3 spaced apart from the second point P2 by the designated interval s in the circumferential shape in the clockwise direction. Thereafter, the heating element 130 extends from the third point P3 to a fourth point P4 spaced apart from the third point P3 by the designated distance, and extends from the fourth point P4 to a fifth point P5 spaced apart from the fourth point P4 by the designated interval s in the circumferential shape in the counterclockwise direction. In such a manner, the heating element 130 extends from an $n^{th}$ point (n being a natural number) to an $n+1^{th}$ point spaced apart from the $n^{th}$ point by a designated distance in the centripetal direction and extends from the $n+1^{th}$ point to an $n+2^{th}$ point spaced apart from the $n+1^{th}$ point in the circumferential shape in the clockwise or counterclockwise direction. Here, n, which is a natural number, is restricted to a finite number. In this embodiment, n is restricted to 11, and thus a sixth point to a thirteenth point P6, P7, P8, P9, P10, P11, P12 and P13 are additionally provided. The final point P13 is spaced apart from the twelfth point P12 by a smaller interval than the designated interval s. The heating element 130 extends from the thirteenth point P13 in the centrifugal direction, passes by the designated interval s, and then extends to the second terminal 132 located at a position close to the first terminal 131.

The electric range 100 includes a power supply unit 150 which supplies electricity to the heating element 130. A description of parts of the power supply unit 150, which are substantially the same as those of the power supply unit 50, will be omitted.

The electric range 100 includes a controller 160 which receives input signals from the respective parts of the electric range 100 and transmits control signals to the respective parts of the electric range 100. The controller 160 may be a microcomputer.

The electric range 100 may include an input unit 170 with which a user inputs on/off signals of the respective heating elements 130*a*, 130*b* and 130*c* and heating degrees of the respective heating elements 130*a*, 130*b* and 130*c*. The input unit 170 may include a plurality of buttons or rotary levers. An input signal may be transmitted to the controller 160 according to a heating degree input through the input unit 170, and the controller 160 may control the power supply unit 150 so as to adjust voltage applied to both ends of the heating element 130 based on the transmitted input signal. Here, the voltage applied to both ends of the heating element 130 means voltage applied between the first terminal 131 and the second terminal 132.

The electric range 100 may include temperature detection units 175 which detect the temperatures of the heating element 130. The temperature detection unit 175 may include a temperature sensor which directly senses temperature. The temperature detection unit 175 may include a device which senses voltage and current applied to the heating element 130, and such a device may sense temperature using a resistance value calculated by the sensed voltage and current.

The electric range 100 includes a display 180 which displays information input through the input unit 170 so as to allow a user to confirm the information. The display 180 may display the current temperatures of the heating elements 130*a*, 130*b* and 130*c* and on/off states of the heating elements 130*a*, 130*b* and 130*c*.

In the controller 160, a plurality of specific resistance values, which are exhibited if the heating element 130 reaches a plurality of specific heating temperatures, are predetermined and stored. The controller 160 receives information on a heating temperature input through the input unit 170 and deduces the specific resistance value of the heating element 130 which is exhibited if the heating element 130 reaches the input heating temperature. The controller 160 calculates a resistance value 52 of the heating element 130 using current I flowing in the heating element 130 and voltage V applied to the heating element 130, sensed by the temperature detection unit 175. If the calculated resistance value reaches the specific resistance value, the controller 160 turns off a switch of the power supply unit 150 so as to interrupt supply of electricity to the heating element 130 and, after a designated time has passed, turns on the switch of the power supply unit 150 so as to re-supply electricity to the heating element 130. Using such an algorithm, electricity may be supplied to the heating element 130.

The sintered predetermined powder forming the heating element 130 of the electric range 100 includes powder of a lanthanide oxide, as described above. The lanthanide oxide may be any one selected from the group consisting of LSM, LSCF, LNF and LC.

A conventional heating element formed by sintering powder including a metal (for example, Ag—Pd) as a main ingredient has a maximal heating temperature of about 500° C. without delamination. However, the heating element 130 in accordance with the present invention may be heated to a temperature exceeding 650° C. without delamination.

The predetermined powder may include metal powder. The metal may be any one selected from the group consisting of Ag, Ag—Pd and Cu. A detailed description thereof, which is substantially the same as the above description, will be omitted.

The predetermined powder may include 40 to 55% by weight of the lanthanide oxide powder and 45 to 60% by weight of the metal powder. For example, the predetermined powder may include 45% by weight of the lanthanide oxide powder and 55% by weight of the metal powder. The predetermined powder may include 50% by weight of the lanthanide oxide powder and 50% by weight of the metal powder. The predetermined powder may include 54% by weight of the lanthanide oxide powder, 45% by weight of the metal powder, and 1% by weight of an arbitrary ingredient powder.

The predetermined shape of the heating element 130 of the electric range 100 is determined by the area of the bottom of a general container 195 which corresponds to a general heating area. The predetermined shape is generally a circular shape, and the diameter d of the circular shape is about 5 to 9 inches. The thickness t of the heating element 130 of the electric range 100 is about 6 to 10 μm. On the assumption that the maximum value of voltage applied to both ends of the heating element 130 is general residential voltage (220 to 240V), when the voltage applied to both ends of the heating element 130 reaches the maximum value, if the proper maximum heating temperature of the heating element 130 is set to 650 to 750° C., a proper resistance value Ω between both ends of the heating element 130 is determined.

In consideration of the general length and area/cross-sectional area of the heating element 130, i.e., a resistor, in the electric range 100, the range of the specific resistance to design the above-described shape of the heating element 130 is preferably about $5*10^{-5}$ to $5*10^{-2}$ Ωm. With reference to Table 2 above, in order to acquire such specific resistance, the composition ratio of the predetermined powder (40 to 55% by weight of the lanthanide oxide powder and 45 to 60% by weight of the metal powder) is advantageous.

More preferably, the predetermined powder may include 40 to 50% by weight of the lanthanide oxide powder and 50 to 60% by weight of the metal powder. The reason for this is that, in consideration of the general length and area/cross-sectional area of the heating element 130, i.e., a resistor, in the electric range 100, the range of the specific resistance to design the above-described shape of the heating element 130 is more preferably about $5*10^{-5}$ to $1*10^{-3}$ Ωm. With reference to Table 2 above, in order to acquire such specific resistance, the composition ratio of the predetermined powder (40 to 50% by weight of the lanthanide oxide powder and 50 to 60% by weight of the metal powder) is more advantageous.

By reason of the luxurious design of the electric range 100, the substrate 110 is generally formed of glass. Hereinafter, it will be assumed that the surface of the substrate 110 is formed of glass.

The arbitrary ingredient may include glass. That is, the predetermined powder may include glass powder. Thereby, adhesive force between the heating element 130 and the substrate 10 may be improved.

The lanthanide oxide may be LC. The baking temperature of LSM, LSCF or LNF powder is about 1,000 to 1,200° C., but the baking temperature of LC powder is relatively low, i.e., about 850° C. The substrate 110 formed of glass has poor temperature resistance, i.e., is weak to a high temperature which is a specific temperature or higher. For example, the commonly used substrate 110 formed of glass may be deformed at a temperature exceeding 950° C. and may thus be used at a temperature which does not exceed 850° C. Since the baking process is carried out under the condition that the predetermined powder is disposed on the surface of the substrate 110, use of LC powder having a low baking temperature is advantageous. The fact that the baking temperature of predetermined powder including LC powder mixed with metal powder is lower than the baking temperature of predetermined powder including LSM, LSCF or LNF powder mixed with metal powder may be confirmed through experimental example 1 (with reference to Table 1).

The particle size of the lanthanide oxide powder may be about 0.4 μm. The particle size of the powder means mean diameter or representative diameter of each grain forming the powder. As the particle size of powder decreases, the baking temperature of the powder is lowered and thus attachment of the heating element 130 to the substrate 110 formed of glass by sintering the powder is advantageous. However, if the particle size of the powder is excessively small, it may be difficult to uniformly distribute the powder in a paste, which will be described later.

The metal may be Ag. The baking temperature of predetermined powder including Ag—Pd or Cu powder is about 900 to 1,000° C., but the baking temperature of predetermined powder including Ag powder is relatively low, i.e., about 850 to 920° C. In order to lower the baking temperature of the predetermined powder, it is advantageous to use the predetermined powder including Ag powder having a low baking temperature.

Hereinafter, a manufacturing method of a surface heater 1 in accordance with one embodiment of the present invention will be described. In the surface heater 1, a predetermined powder will be described as including metal powder.

The manufacturing method includes manufacturing a paste by mixing an organic solvent and a binder with the predetermined powder. The predetermined powder, the organic solvent and the binder are mixed at a temperature of 10 to 30° C. for 2 to 6 hours using a mixer. The paste has viscosity of about 100 to 200 kcP.

The manufacturing method further includes applying the paste to the surface of the substrate 10 in a predetermined shape. As one example, the paste may be applied to the surface of the substrate 10 using a screen printer. As another example, the paste may be applied to the surface of the substrate 10 through a deposition method. The paste is applied to the surface of the substrate 10 to a thickness t of about 6 to 10 μm.

The manufacturing method further includes drying the applied paste at a predetermined temperature and removing the organic solvent and the binder from the paste, after application of the paste. In drying, the substrate 10 may be dried at a temperature of about 150° C. for about 10 minutes using an oven and, then, the organic solvent and the binder may be removed at a temperature of about 400° C. for about 30 minutes using the oven.

The manufacturing method further includes baking the substrate 10, after drying. In the manufacturing method of the surface heater 1 in accordance with the present invention, the baking temperature is within a range of about 800 to 900° C.

In baking, an acquired predetermined powder may be sintered at a baking temperature of 900° C. or lower. If the predetermined powder is a mixture of lanthanide oxide powder and metal powder, the baking temperature may be lowered to 900° C. or lower. Thereby, even if the substrate 10 is formed of glass, baking may be effectively carried out.

If the lanthanide oxide of the predetermined powder is LC and the metal is Ag, the baking temperature may be further lowered. In this case, in baking, the predetermined powder may be sintered at a baking temperature of 850° C. or lower. Thereby, even if the substrate 10 is formed of glass, baking may be more effectively carried out.

As apparent from the above description, in a surface heater in accordance with one embodiment of the present invention, a heating element is formed of a mixture of a lanthanide oxide and a metal, and may thus have a smaller degree of expansion according to temperature change than that of metal and prevent delamination of the heating element from a substrate.

Further, the heating element has a small degree of expansion according to temperature change and, thus, the maximum temperature of the heating element may be greatly raised. For example, the temperature of the heating element may be raised to a high temperature, i.e., 650 to 750° C.

Further, lanthanide oxides are relatively inexpensive and, thus, manufacturing costs of the heating element may be reduced.

Further, the heating element may use the lanthanide oxide and have necessary specific resistance.

Moreover, the baking temperature of the heating element may be greatly lowered by sintering the mixture of lanthanide oxide powder and metal powder.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus comprising a surface heater, the surface heater comprising:

a heating substrate comprising an electrically insulating surface wherein the electrically insulating surface comprises a glass material;

a heating element attached to the electrically insulating surface, the heating element comprising lanthanide oxide and a metal material; and a power supply unit to supply electricity to the heating element, wherein the heating element is attached to the electrically insulating surface by sintering a predetermined powder comprising a lanthanide oxide powder and a metal powder, and wherein the heating element comprises 30 to 60% by weight of the lanthanide oxide and 40 to 70% by weight of the metal material, the lanthanide oxide is Lanthanum Cobalt (LC).

2. The apparatus of claim 1, wherein the metal material is Silver (Ag).

3. The apparatus of claim 2, wherein a particle size of the lanthanide oxide powder is 0.4 μm.

4. The apparatus of claim 2, wherein the heating element comprises 40 to 55% by weight of the lanthanide oxide and 45 to 60% by weight of the metal material.

5. The apparatus of claim 1 wherein a particle size of the lanthanide oxide powder is 0.4 μm.

6. The apparatus of claim 5, wherein the heating element comprises 40 to 55% by weight of the lanthanide oxide and 45 to 60% by weight of the metal material.

7. The apparatus of claim 1, wherein the heating element comprises 40 to 55% by weight of the lanthanide oxide and 45 to 60% by weight of the metal material.

* * * * *